US005725420A

United States Patent [19]

Torii

[11] Patent Number: 5,725,420

[45] Date of Patent: Mar. 10, 1998

[54] POLISHING DEVICE HAVING A PAD WHICH HAS GROOVES AND HOLES

[75] Inventor: Koji Torii, Tokyo, Japan

[73] Assignee: NEC Corporation, Tokyo, Japan

[21] Appl. No.: 731,916

[22] Filed: Oct. 22, 1996

[30] Foreign Application Priority Data

Oct. 25, 1995 [JP] Japan ..... 7-277836

[51] Int. Cl.[6] ..... B24B 5/00

[52] U.S. Cl. ..... 451/285; 451/286; 451/287; 451/288; 451/289; 451/527; 451/41

[58] Field of Search ..... 451/530, 527, 451/528, 529, 921, 285–290, 41

[56] References Cited

FOREIGN PATENT DOCUMENTS 236066 2/1990 Japan .

*Primary Examiner*—Robert A. Rose
*Assistant Examiner*—George Nguyen
*Attorney, Agent, or Firm*—Whitham, Curtis, Whitham & McGinn

[57] ABSTRACT

Shallow grooves are formed on the surface of a hard layer of a polishing pad for polishing the wafer so as to join a plurality of. Since the grooves are formed for causing no negative pressure between the polishing pad and the wafer, the distance between the grooves is made more than several times as large as the pitch between the holes.

20 Claims, 16 Drawing Sheets

POLISHING DEVICE HAVING A PAD WHICH HAS GROOVES AND HOLES

BACKGROUND OF THE INVENTION

1. Field of the Invention

The present invention relates to a polishing device for wafers and, more particularly, to a shape of a polishing pad of such a device.

2. Description of Related Art

Recently, a Chemical-Mechanical Wafer Polishing method (hereinafter referred to as CMP) has been used for polishing a surface of a wafer as silicon for making on LSI. According to the method, the surface of a wafer is polished by the combination of mechanical and chemical actions as shown in FIG. 21 and FIG. 22.

The polishing device has a table 11 having a planar surface and is capable of rotational movement. The table 11 has a size of about 50 to 100 cm in diameter and made of a highly rigid material. A polishing pad 1 of about 1 to 3 mm thickness is applied on the surface of the table 11.

Further, the polishing device has a carrier 12 of a size corresponding to a diameter of a semiconductor wafer 15, which is above the table 11 and has a surface in parallel with the surface of the table 11. The carrier 12 is driven rotationally by a spindle 14. Further, the polishing device has a guide ring 13 at the outer circumference of the carrier 12 for holding the semiconductor wafer 15 during polishing.

After mounting the semiconductor wafer 15 to the inside of the guide ring 13 of the carrier 12, polishing is applied by lowering the carrier 12 on the polishing pad 1, exerting a load of about 300 to 600 g/cm$^2$ to the semiconductor wafer 15 while supplying a polishing slurry 16 and, simultaneously, giving a rotational movement of about 20 to 50 rpm to the table 11 and the carrier 12 in one direction.

There are various kinds of polishing slurry 16 depending on the application. For example, for polishing an oxide film, a polishing slurry containing about 10 to 20% of silica ($SiO_2$) particles and adjusted to about pH 10–11 with KOH or $NH_4OH$ is used generally.

As the polishing pad used for polishing the semiconductor wafer 15, for example, a non-woven fabric impregnated with polyurethane or a polyurethane foam laminated thereon.

The polyurethane disposed on the side for polishing the semiconductor wafer 15 is rigid. For example, a hardness of 95 which is a regulation of Shore A is used. For polishing the surface of the semiconductor wafer 15 flat, it is necessary that the surface of the polishing pad 1 on the side for polishing the semiconductor wafer 15 is highly rigid. On the contrary, if the hardness of the pad is high, no uniform polishing can be applied over the entire surface of the semiconductor wafer 15 if the wafer is warped. Then, a soft material constituted, for example, with a non-woven fabric is inserted to the lower layer to deform the pad so as to conform the shape of the semiconductor wafer 15. Therefore it is possible to minimize the effect caused by the shape of the semiconductor wafer 15.

By the way, although the foamed polyurethane is hard, it deforms on the order of micrometer by a load exerted to polish the wafer 15. Particularly, since the foamed polyurethane swells upon absorption of water, the deformation amount is increased by repeated polishing. Since the peripheral portions of the wafer 15 are brought into intense contact by the deformation of the hard layer of the polishing pad 1, supply of the polishing slurry 16 is restricted.

Further, the hard layer 7 displaces downwardly by a load exerted from the semiconductor wafer 15 as shown in FIG. 23, thereby it deforms considerably. Accordingly, a contact pressure between the edge of the semiconductor wafer 15 and the surface of a hard layer 7 is liable to be increased, by which the edge portion of the semiconductor wafer 15 tends to become thinner compared with the central portion of the semiconductor wafer 15.

In FIG. 23, a reference numeral 17 denotes a rear face pad. The rear face pad 17 is an elastic object inserted between a carrier for applying the load and the semiconductor wafer, to improve the uniformness by the rear face pad 17.

Accordingly, grooves are formed on the surface of the foamed polyurethane of the pad 1 as shown in FIG. 24 and FIG. 25. The grooves 3 are used for facilitating the supply of the polishing slurry 16 and they are formed at a high density on the polishing surface of the hard layer 7 of the polishing pad 1. Generally, the grooves 3 are arranged in a lattice-like and high density pattern. For example, grooves each of 2 mm width and 0.5 to 0.8 mm depth are arranged each at 15 mm pitch.

In the polishing pad of this type, if a load is applied, the strength is lowered at the portion of the grooves 3 because the regions surrounded with the grooves 3 tend to deform independently vertically. This can temporarily overcome the problem that the contact pressure between the edge of the semiconductor wafer 15 and the surface of the hard layer 7 tends to be increased.

Further, the supply of the polishing slurry 16 is improved. But a great amount of the slurry 16 is required during polishing. Particularly, if the table 11 is rotated at a high speed for attaining a high polishing rate, the slurry 16 is easily discharged by a centrifugal force.

For overcoming the problem in the increase of the required amount of the slurry 16, Japanese Patent Laid-open Publication Hei 2-36066 discloses a technique of reducing the necessary amount of the slurry 16 without forming grooves to the outermost circumference of the polishing pad 1. However, if the speed of rotation is higher than about 20 rpm, it is not effective to reduce the quantity of the slurry 16 because the liquid surface of the slurry is inclined.

Accordingly, instead of grooves, holes 2 are formed on the surface of the foamed polyurethane as shown in FIG. 26 and FIG. 27. For example, holes of 1.5 mm diameter are formed over the entire surface of the polishing pad 1 at 5 mm pitch. It is designed that the amount of the slurry is the same as the amount of the slurry using a pad with grooves. However, the holes retain more polishing slurry 16 rather than the grooves because the slurry 16 is not discharged by a centrifugal force very much. Therefore the amount of the slurry 16 in this case is less than the amount of the slurry using a pad with grooves.

However, the pad having this shape has a problem. When the carrier 12 is raised from the wafer 15 to be removed after the completion of the polishing, since a space between the wafer 5 and the polishing pad 1 is tightly sealed, the wafer 15 deforms like a suction to cause a negative pressure between the polishing pad 1 and the semiconductor wafer 15. And sometimes the wafer 15 is detached from the carrier 12 by the negative pressure.

SUMMARY OF THE INVENTION

It is, therefore, an object of the present invention to provide a polishing pad which consumes less amount of the polishing slurry than the prior art and is capable of reducing tight sealing between the pad and a semiconductor wafer.

It is another object of the present invention to provide a polishing pad causing less load to an edge portion of a semiconductor wafer when a load is exerted from the semiconductor wafer.

A polishing pad according to the present invention includes a plurality of holes for retaining a polishing slurry for polishing a wafer and a plurality of grooves formed on the surface of the pad for reducing tight sealing between the pad and the wafer.

As a result, it is possible to reduce the quantity of the slurry because of the holes. And it is possible to prevent the tight sealing and the excessive load because of the grooves.

BRIEF DESCRIPTION OF THE DRAWINGS

The above and the objects, features and advantages of the present invention will be more apparent from the following description taken in conjunction with the accompanying drawings, in which.

DESCRIPTION OF PREFERRED EMBODIMENTS

Figure 24:
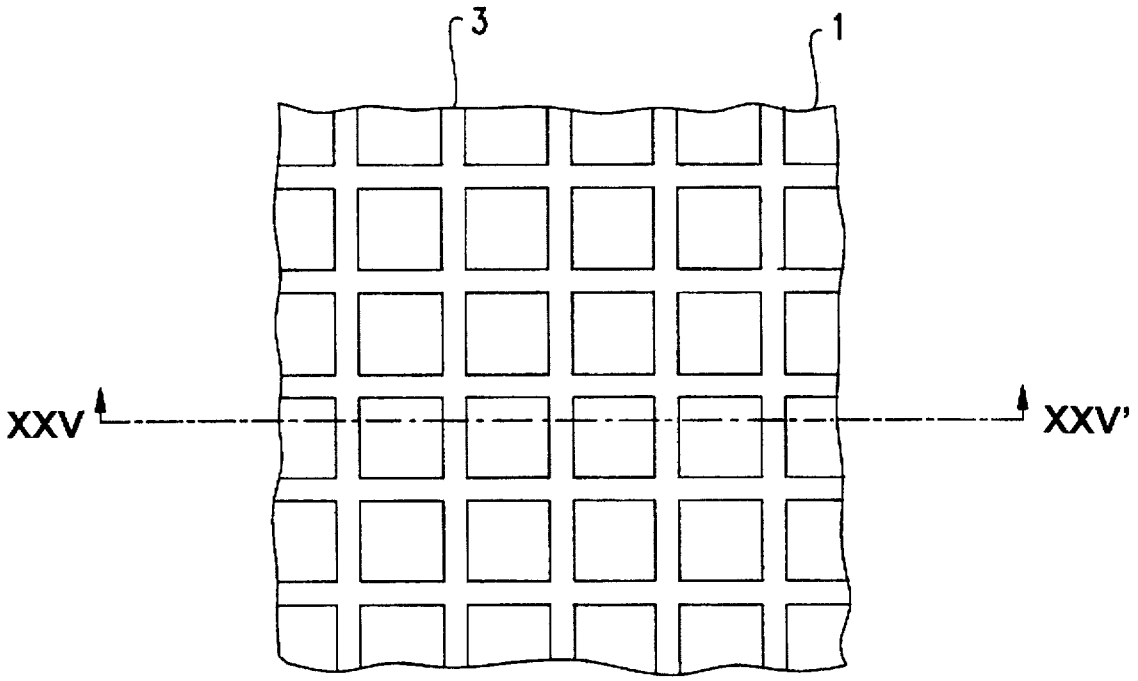
FIG.24 PRIOR ART
FIG. 24 is a fragmentary plan view illustrating a polishing pad of the prior art.
Figure 25:
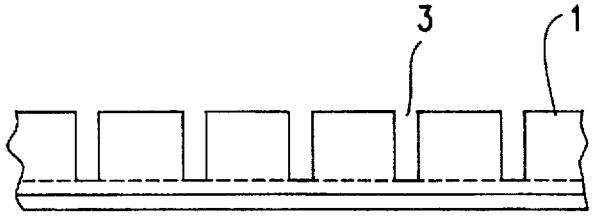
FIG. 25 is a cross sectional view taken along line B–B' in FIG. 24.

In a polishing pad as a preferred embodiment of the present invention, required minimum of grooves are formed in a polishing pad having holes for retaining the polishing slurry. The grooves are used for reducing the tight sealing and for causing less load to an edge portion of the wafer, therefore the pitch is several times higher than the pitch of the prior art in FIG. 24. That is to say, the grooves of this invention are not effective to provide the polishing slurry to the wafer but are effective to provide the air which has normal pressure to the holes.

Figure 21:
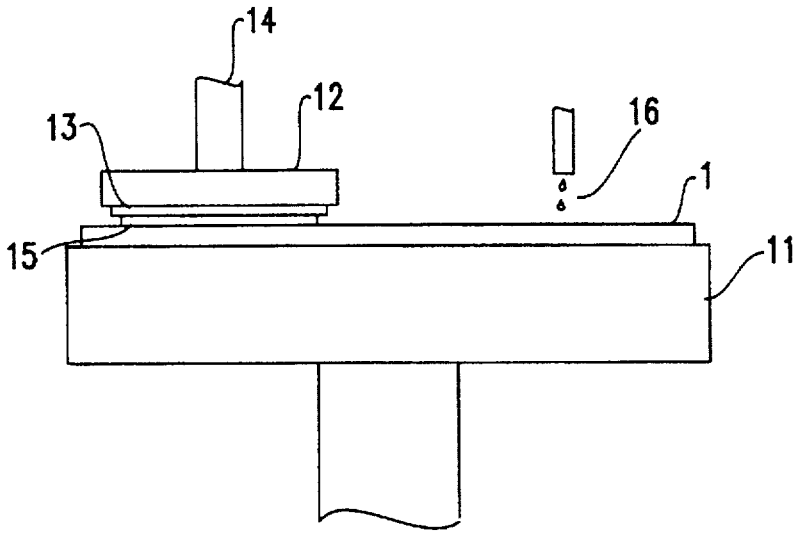
FIG.21 PRIOR ART
FIG. 21 is a fragmentary side elevational view of a conventional polishing device.
Figure 22:
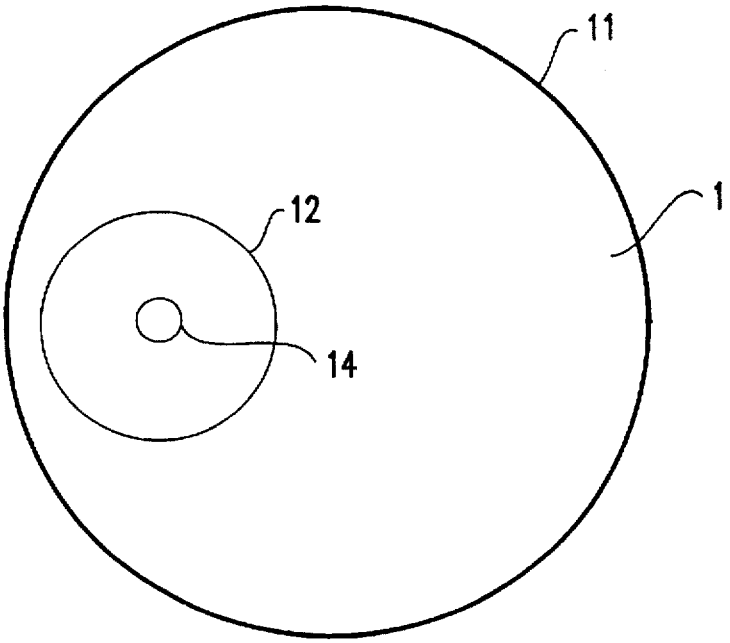
FIG.22 PRIOR ART
FIG. 22 is a fragmentary plan view of a conventional polishing device.
Figure 23:
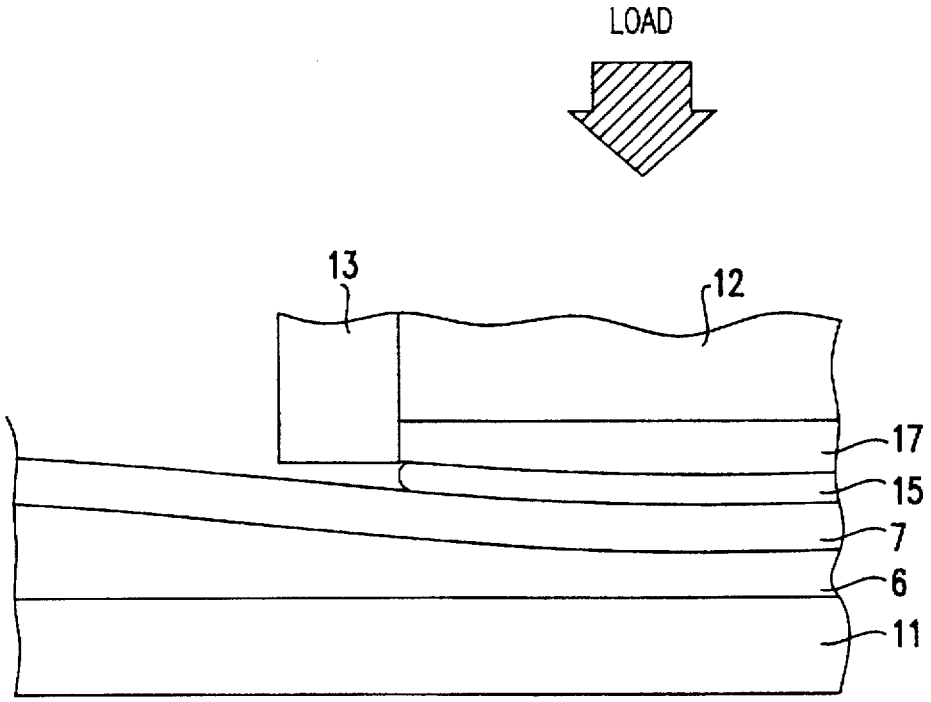
FIG.23 PRIOR ART
FIG. 23 is a fragmentary cross sectional view illustrating the state of applying a load on a semiconductor wafer in a polishing device using a polishing pad having a continuous plane.

The polishing device is the same as the prior art in FIG. 21 and FIG. 22 except for the shape of the polishing pad. Therefore the following explanation the same figure captions are used at the same part as the prior art.

Figure 1:
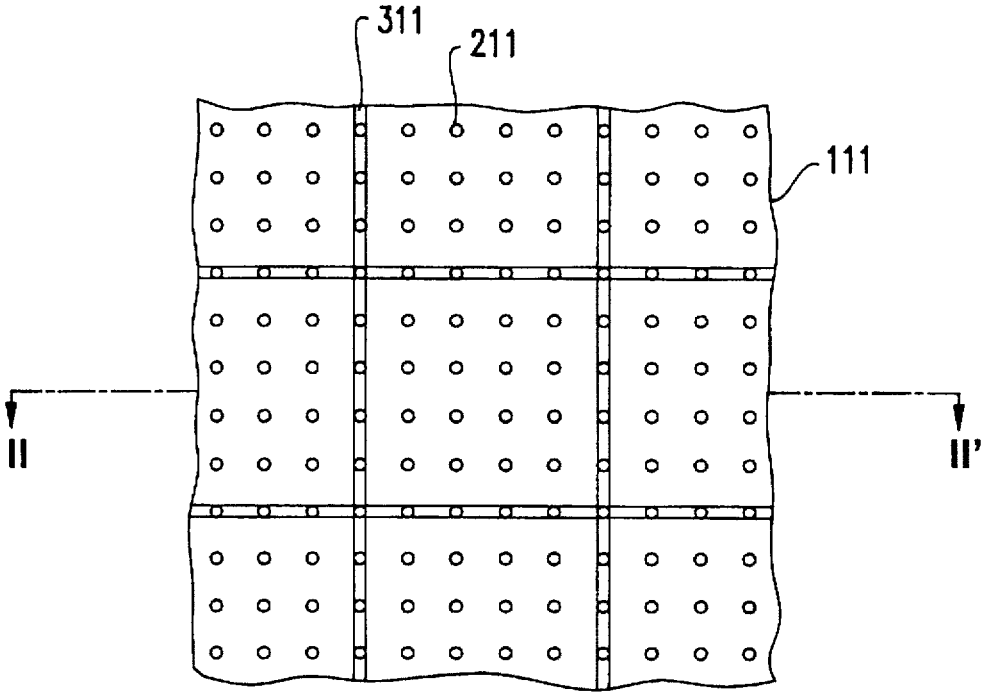
FIG. 1 is a plan view illustrating a first embodiment according to the present invention.
Figure 2:
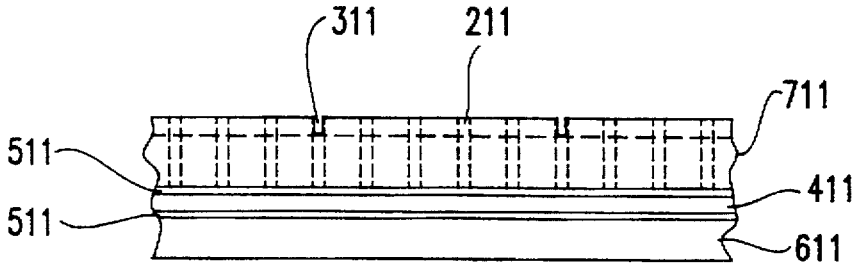
FIG. 2 is a cross sectional view taken along line A–A' in FIG. 1.

A polishing pad as a first embodiment of the present invention, as shown in FIG. 1 and FIG. 2, has shallow grooves 311 which are formed to the surface of a hard layer 711 of the polishing pad 111. A plurality of holes 211 are connected by the grooves 311 in order not to cause a negative pressure between the polishing pad 111 and the semiconductor wafer 15. The width of the groove 311 may be less than the diameter of the holes 211 which is about 1.5 mm and the depth may be about 0.3 mm. Further, the distance between the grooves 311 is more than several times as large as the distance between the holes 211. For example, the distance between the grooves is 30 mm–60 mm and the distance between the holes is about 5.0 mm in this embodiment.

Usually, the foamed polyurethane as the hard layer 711 of the polishing pad 1 is molded using a predetermined vessel. Further, the hard layer 711 is cured by applying a heat treatment and then sliced to a desired thickness. Since holes 211 are formed by punching, fabricated holes 211 generally penetrate the hard layer 711. Then, since a film 411 which is made of a polyester attached to a lower surface of the hard layer 711 with glue 511, the holes 211 are closed at the bottom. Further, a non-woven fabric material is used usually as a soft layer 611 and it is attached to the film 411 with glue 511. Since the film 411 which is waterproof is interposed between the hard layer 711 and the soft layer 611, the construction in FIG. 2 does not allow water to permeate the soft layer 611. Since the mechanical property of the soft layer 611 is deteriorated by water absorption, a material which is water proof such as the polyester film is necessary.

According to the present invention, since very shallow grooves 311 are formed to the surface of a portion of the holes 211, a sealing property between the polishing pad 111 and the semiconductor wafer 15 can be reduced to facilitate removal of the semiconductor wafer 15 from the polishing pad 1 after the completion of polishing. Further, this construction maintains the strength of the polishing pad and the performance of the polishing slurry 16.

Figure 3:
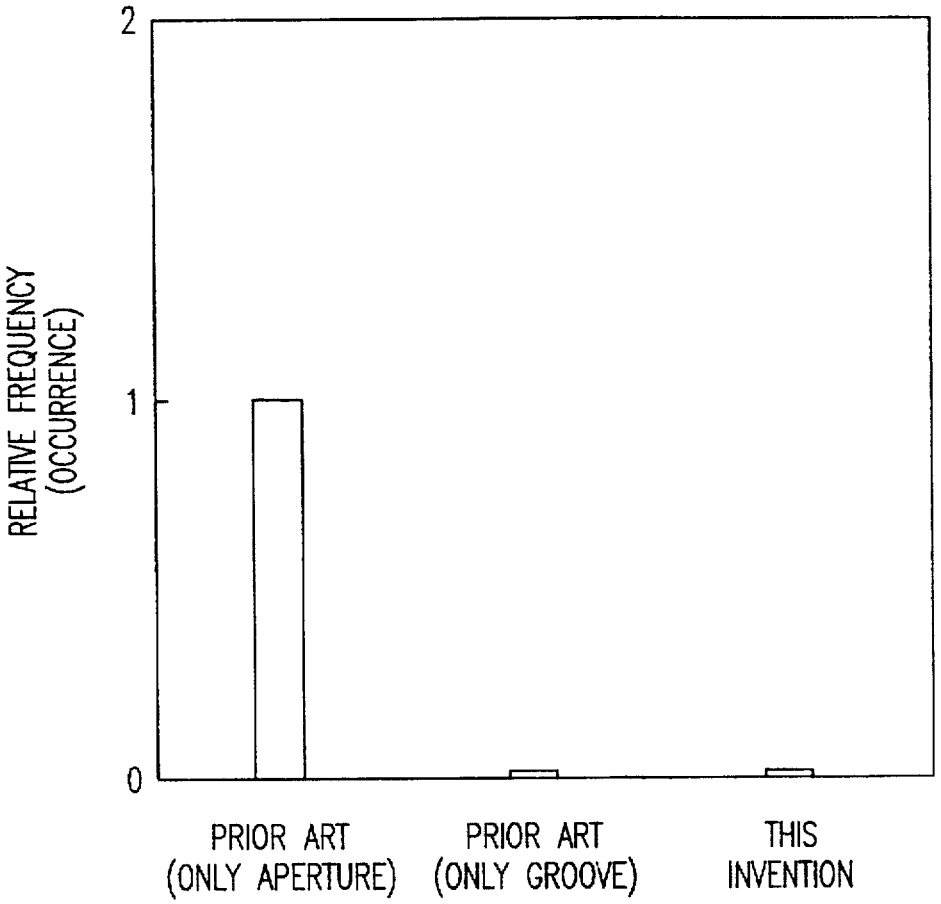
FIG. 3 is a diagram illustrating the effect of the present invention due to grooves for preventing a negative pressure.
Figure 26:
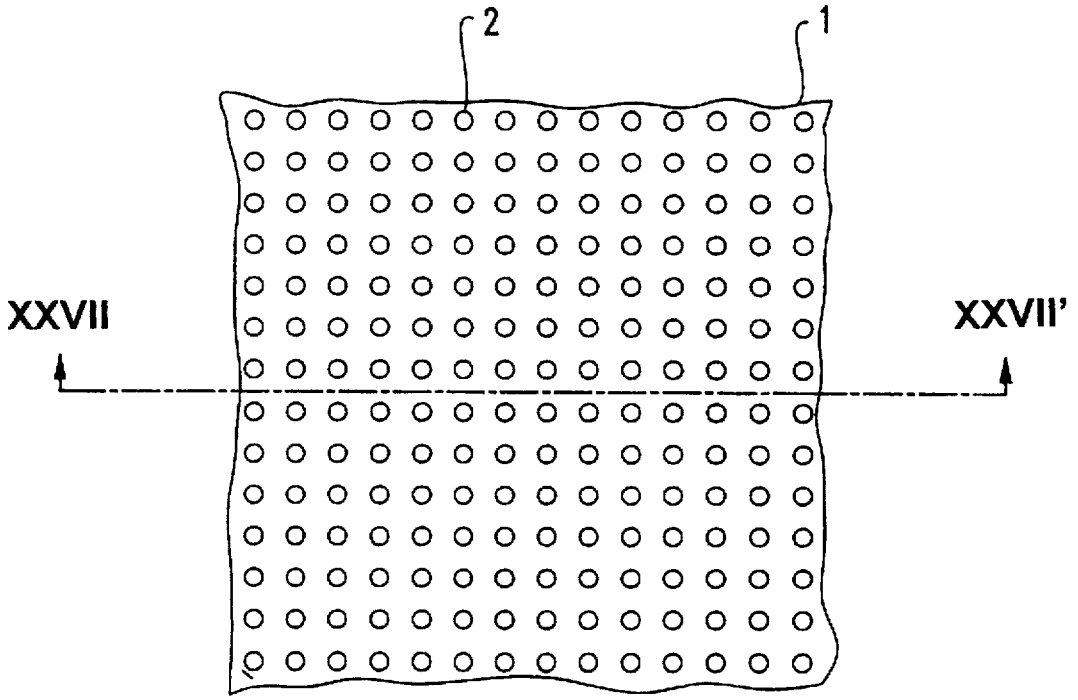
FIG.26 PRIOR ART
FIG. 26 is a plan view illustrating another polishing pad of the prior art.
Figure 27:
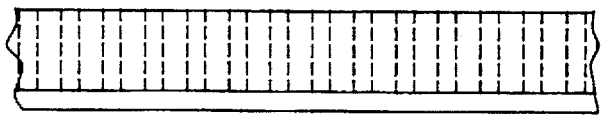
FIG. 27 is a cross sectional view taken along line B–B' in FIG. 26.

FIG. 3 shows an occurrence rate of the semiconductor wafer 15 to be retained on the surface of the polishing pad and not to be taken away easily because of the negative pressure. As can be seen from the figure, residue of the semiconductor wafer 15 can be improved remarkably compared with the polishing pad in FIG. 26. Further, an equivalent effect can be obtained as compared with that of the polishing pad in FIG. 24.

Figure 4:
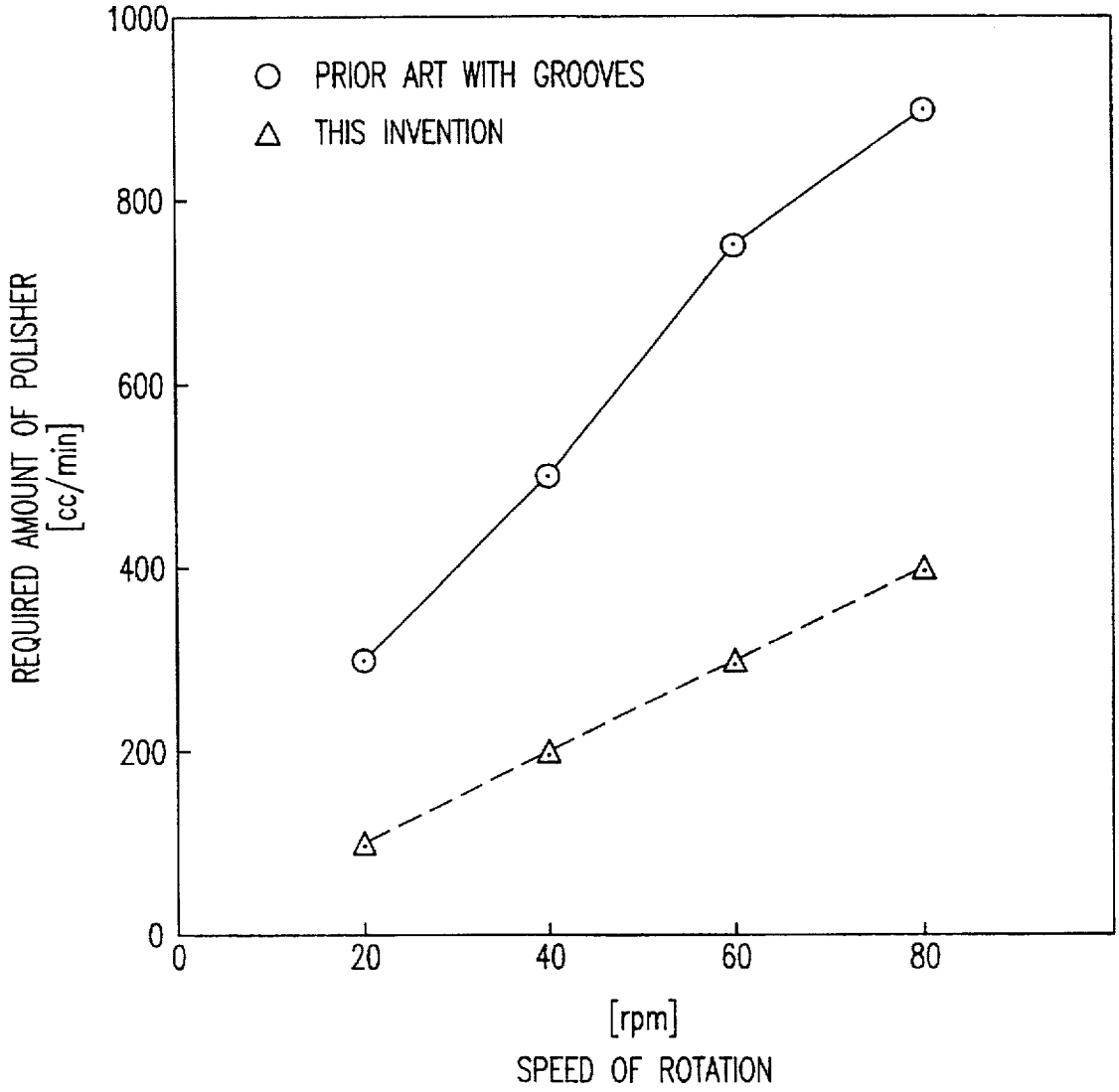
FIG. 4 is a diagram illustrating a relationship between the speed of rotation of a table and a flow rate of a polishing slurry in the prior art having grooves and the present invention.

FIG. 4 shows the result of comparison for the amount of the polishing slurry 16 required for obtaining a predetermined polishing rate. The polishing pad 111 of the first embodiment can reduce the amount of using the polishing slurry 16 since the slurry 16 is retained mainly by the holes 211 as compared with the polishing pad 1 in FIG. 24.

Further, although not illustrated, since the strength of the hard layer 711 of the polishing pad 111 is maintained, the load on the soft layer 611 as the lower layer of the polishing pad 111 is decreased, which also reduces deterioration after lapse of time.

Figure 5:
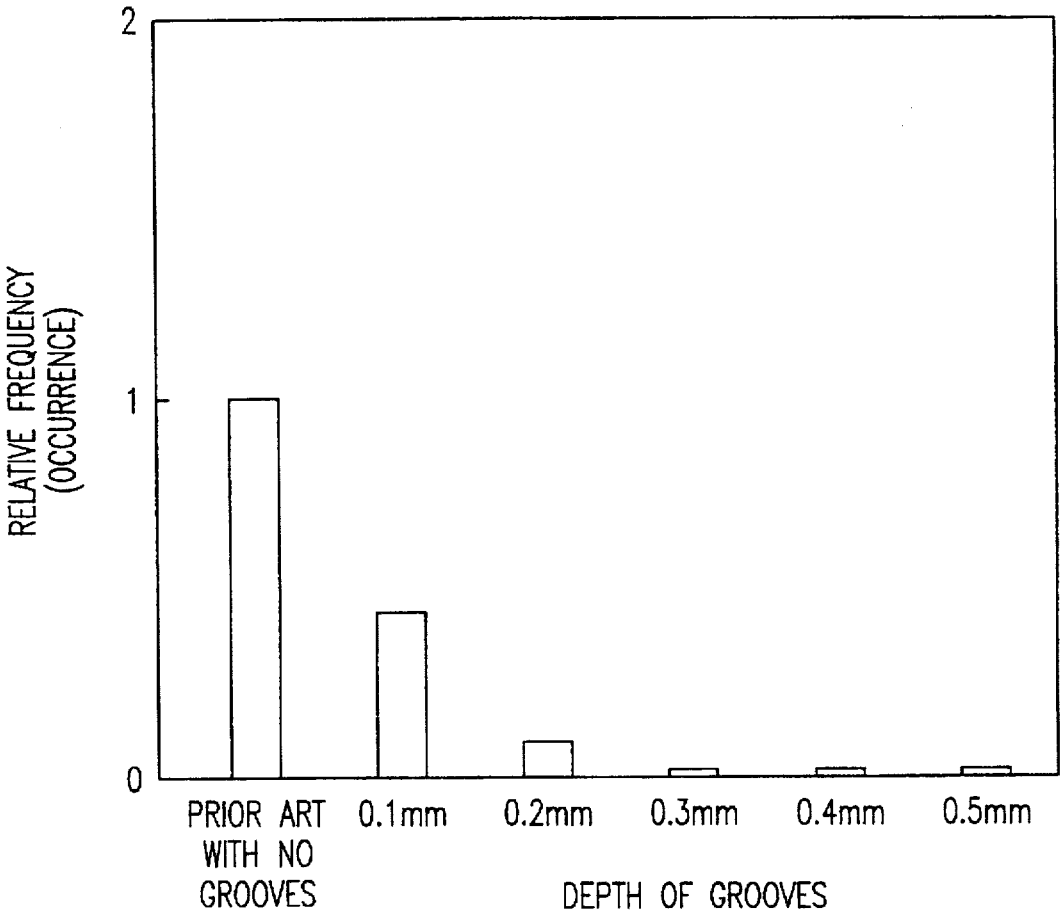
FIG. 5 is a diagram illustrating a relationship between the depth of grooves and a probability of causing sticking to a semiconductor wafer.
Figure 6:
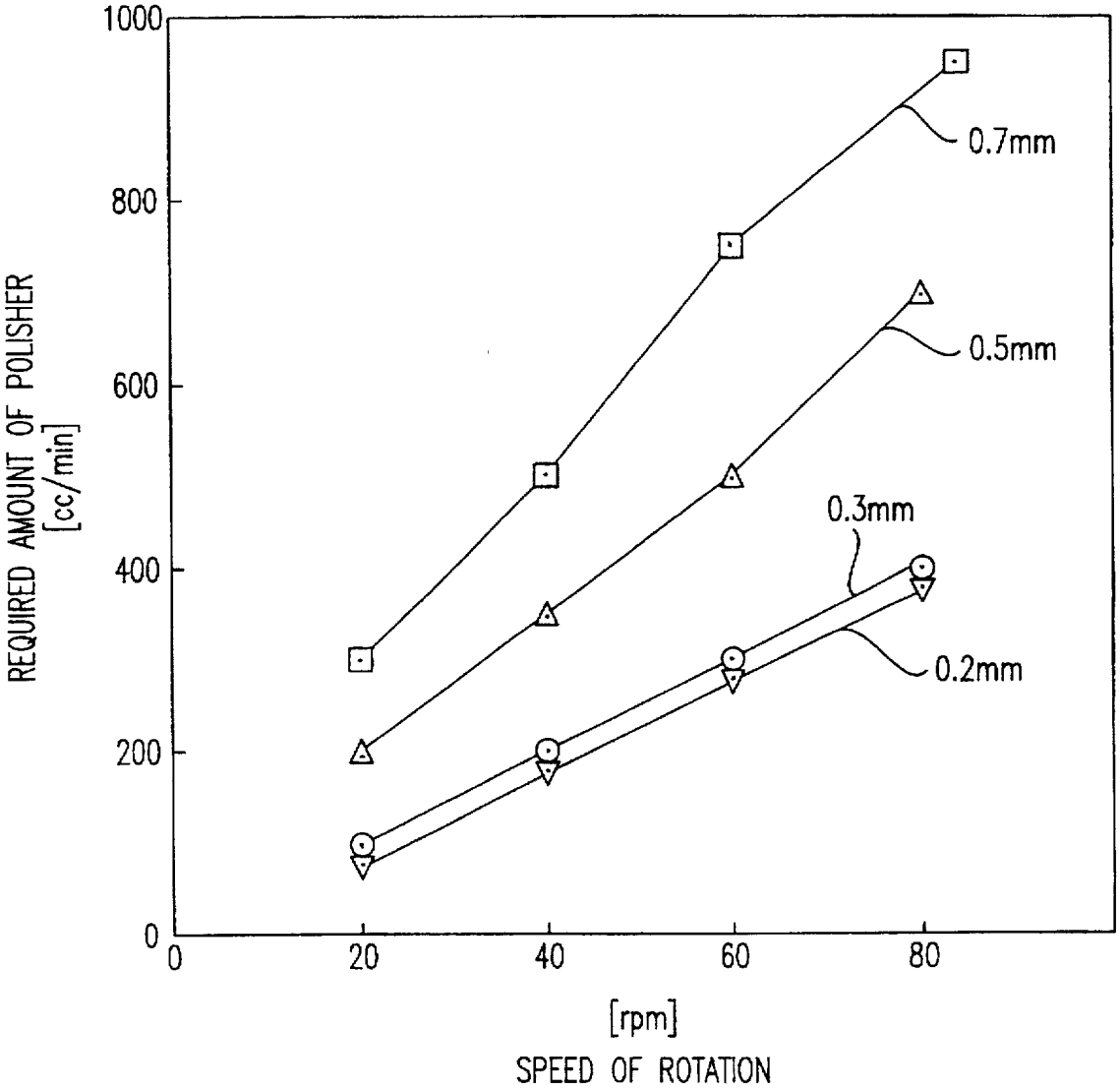
FIG. 6 is a diagram illustrating a relationship between the necessary flow rate of the polishing slurry and the depth of the grooves at each speed of rotation of the table.

FIG. 5 shows data illustrating a relationship between the depth of the grooves and the rate for the occurrence of sticking of the semiconductor wafer, while FIG. 6 illustrates a relationship between the required flow rate of the polishing slurry and the depth of the groove at each rotation of the table. It can be seen from the two figures that the preferable depth of the grooves is 0.2 mm–0.5 mm. The most preferable depth of the grooves is about 0.3 mm.

Figure 7:
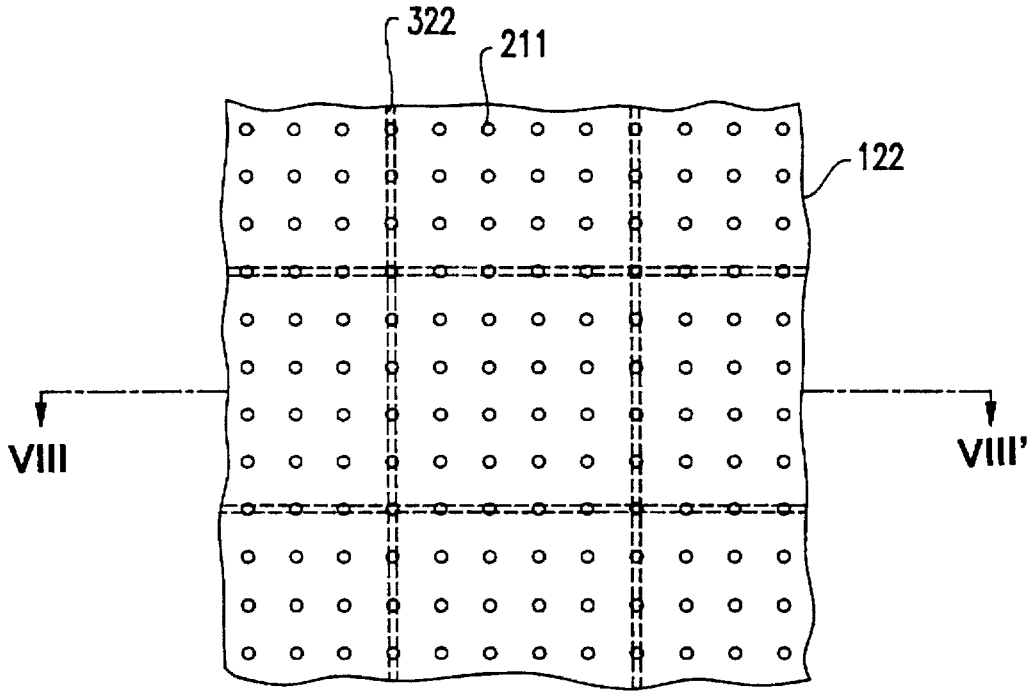
FIG. 7 is a plan view illustrating a second embodiment of the present invention.
Figure 8:
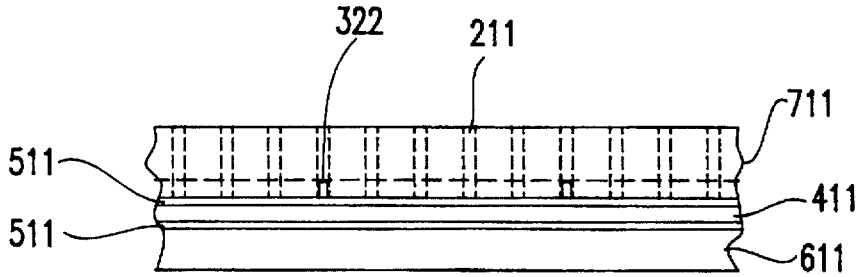
FIG. 8 is a cross sectional view taken along line A–A' in FIG. 7.

A polishing pad as the second embodiment is as shown in FIG. 7 and FIG. 8. The shape of the pad is the same as the pad of the first embodiment except for the position of tunnels. Therefore the same figure caption as the first embodiment is used except for the tunnels. Shallow tunnels 322 are formed to the contact part between hard layer 711 and the polyester film 411 and the tunnels are connected to several holes 211.

Figure 9:
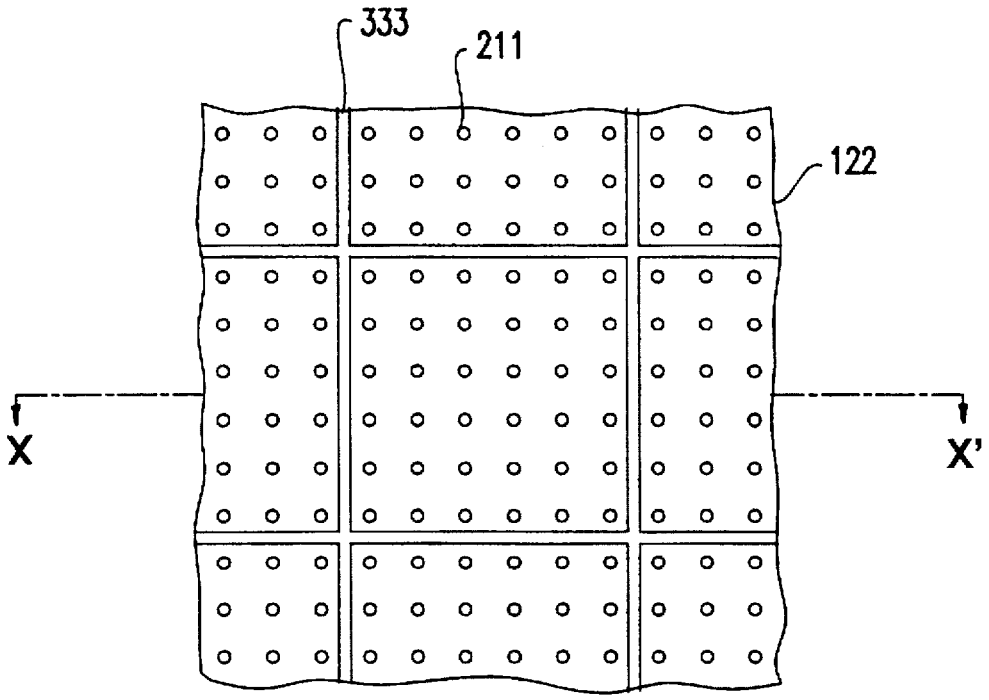
FIG. 9 is a plan view illustrating, a third embodiment of the present invention.
Figure 10:
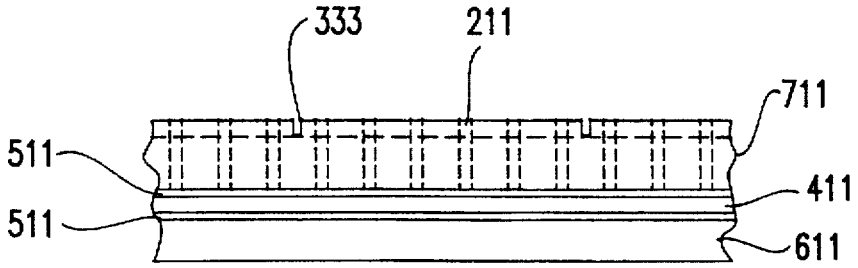
FIG. 10 is a cross sectional view taken along line A–A' in FIG. 9.

The tunnels 322 are formed for causing no negative pressure between the polishing pad 122 and the semiconductor wafer 15 like that in the first embodiment. The polishing pad in this embodiment has the same effect as that of the polishing pad in the first embodiment. A polishing pad as the third embodiment is as shown in FIG. 9 and FIG. 10. The shape of the pad is the same as the pad of the first embodiment except for the position of grooves. Therefore the same figure caption as the first embodiment is used except for the grooves. Shallow grooves 333 are formed at the surface of the hard layer 711 with avoiding the holes 211. That is to say, the grooves 333 are not connected to the holes 211.

The grooves 333 are formed for causing no negative pressure between the polishing pad 1 and the semiconductor wafer 15, the depth of the groove 333 may be about 0.3 mm. The polishing pad 122 in the third embodiment also has the effect equal with that of the polishing pad in the first embodiment.

Figure 11:
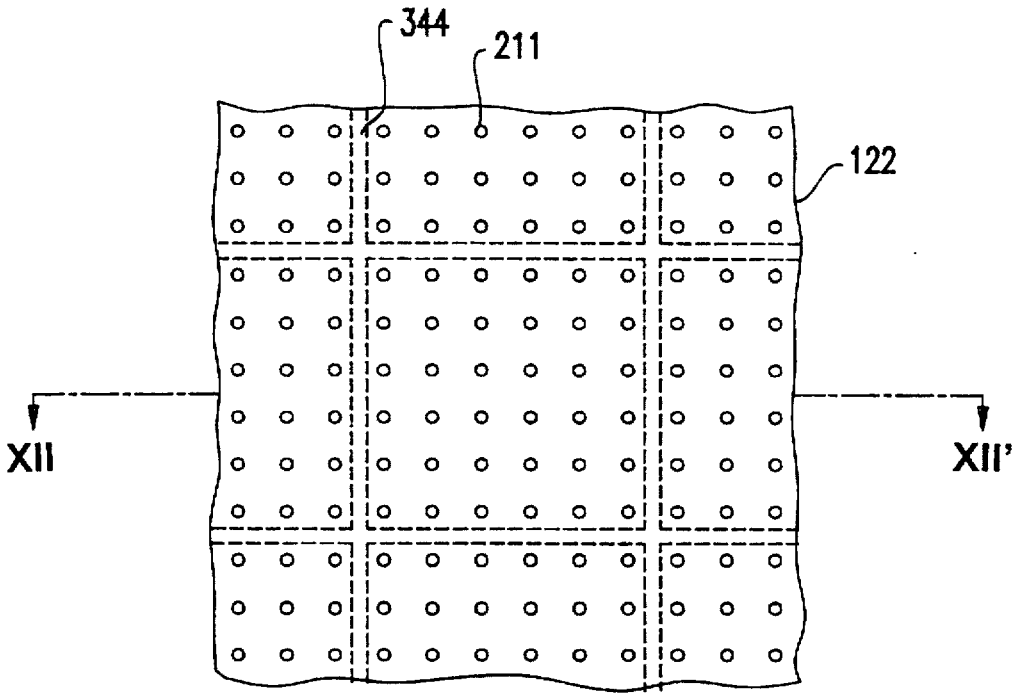
FIG. 11 is a plan view illustrating a fourth embodiment of the present invention.
Figure 12:
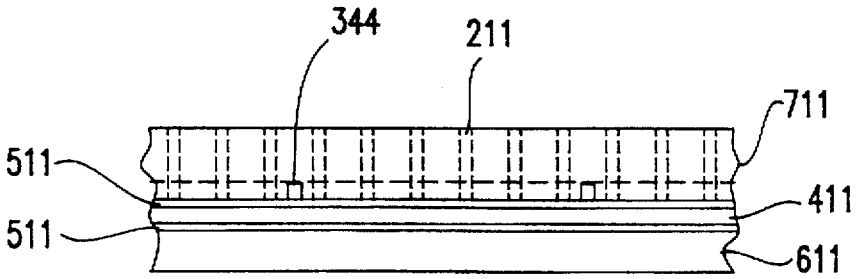
FIG. 12 is a cross sectional view taken along line A–A' in FIG. 11.

A polishing pad as the fourth embodiment is as shown in FIG. 11 and FIG. 12. The shape of the pad is the same as the pad of the second embodiment except for the position of tunnels. Therefore the same figure caption as the second embodiment is used except for the tunnels 344. Shallow tunnels 344 are formed to the contact part between hard layer 711 and the polyester film 411 and the tunnels are made with avoiding holes 211. That is to say, the tunnels 344 are not connected to the holes 211.

Figure 13:
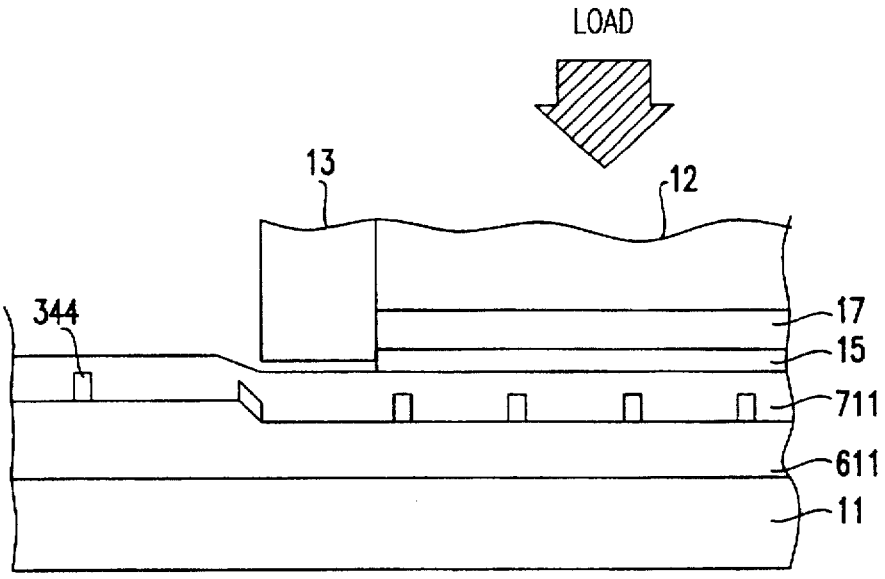
FIG. 13 is a fragmentary cross sectional view illustrating the state of applying a load on a semiconductor wafer in a polishing device using a polishing pad having grooves.

The grooves 344 have no effect of preventing the negative pressure. Thus, the fourth embodiment is different from the first to third embodiments described previously. However, as compared with the polishing pad having only the holes 2 in the prior art, the region surrounded by the groove 344 is easily transformed independently as shown in FIG. 13. Therefore the hard layer 711 is contacted with the semiconductor wafer 15 like a flat plate because the shape of the hard layer 711 is transformed to decrease excessive load on the edge portion of the semiconductor wafer 15.

Figure 14:
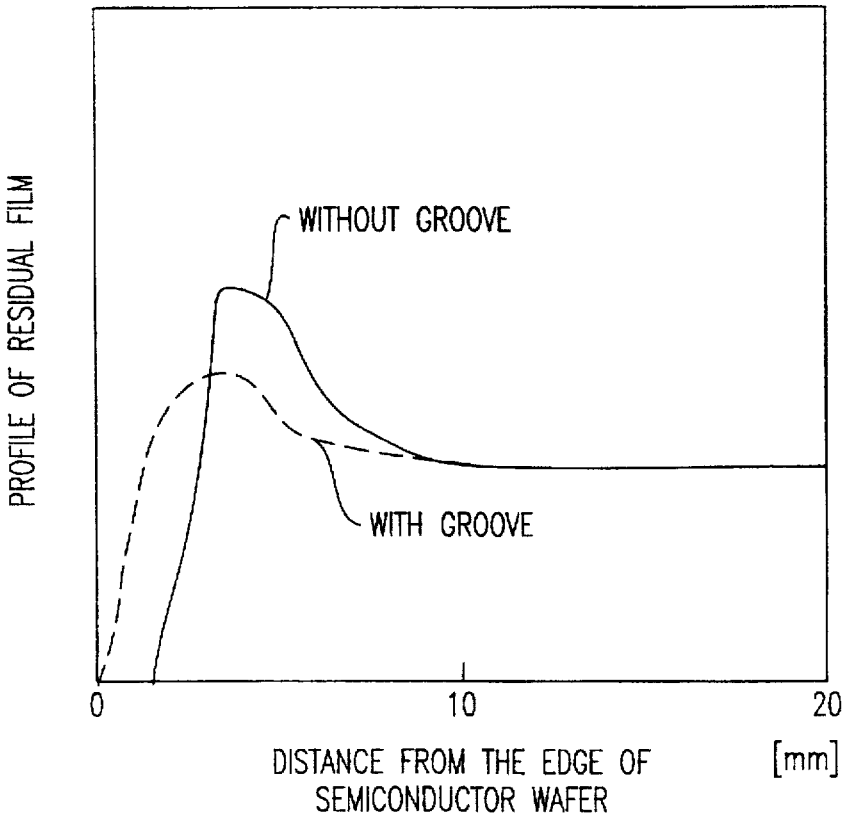
FIG. 14 is a diagram illustrating a relationship between a residual film profile and a distance from the edge of a semiconductor wafer in each of the cases with or without grooves.

FIG. 14 is a view illustrating a relationship between the profile of the residual film and the distance from the edge of the semiconductor wafer in each of the cases with and without grooves. As can be seen from the figure, a improvement has been made as compared with the polishing pad having only the holes 2 in the prior art. This effect is obtained not only in this embodiment but also the first to third embodiments.

Figure 15:
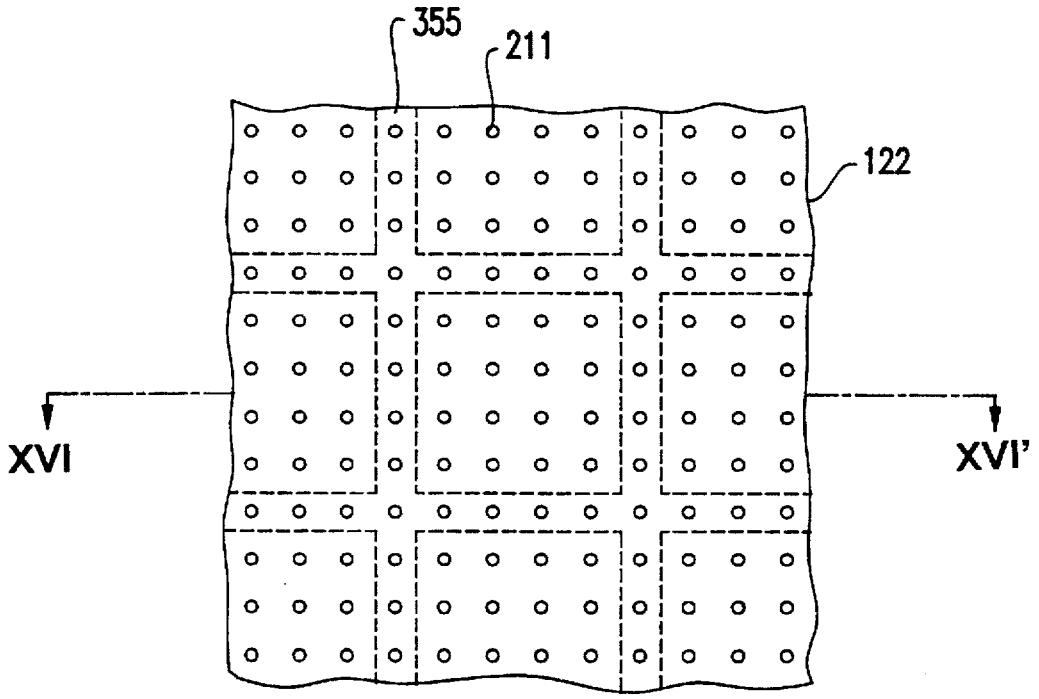
FIG. 15 is a plan view illustrating a fifth embodiment of the present invention.
Figure 16:
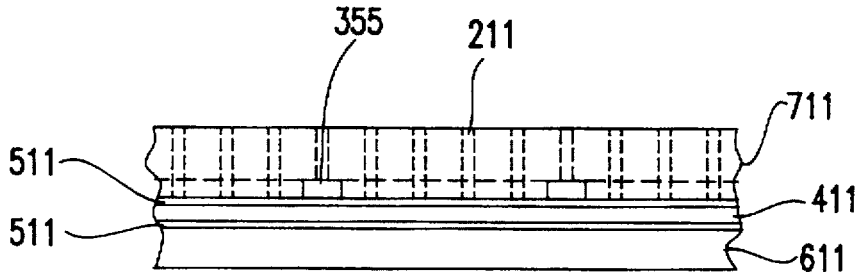
FIG. 16 is a cross sectional view taken along line A–A' in FIG. 15.

A polishing pad as the fifth embodiment is as shown in FIG. 15 and FIG. 16. The shape of the pad is the same as the pad for the second embodiment except of the width of tunnels. That is to say, the width of the tunnel 355 is wider than the width of the tunnel 344 of the second embodiment. Therefore the same figure caption as the second embodiment is used except for the tunnels 355. The width of the tunnel 355 is wider than the diameter of the hole 211.

This embodiment has the same effects as the second embodiment.

Figure 17:
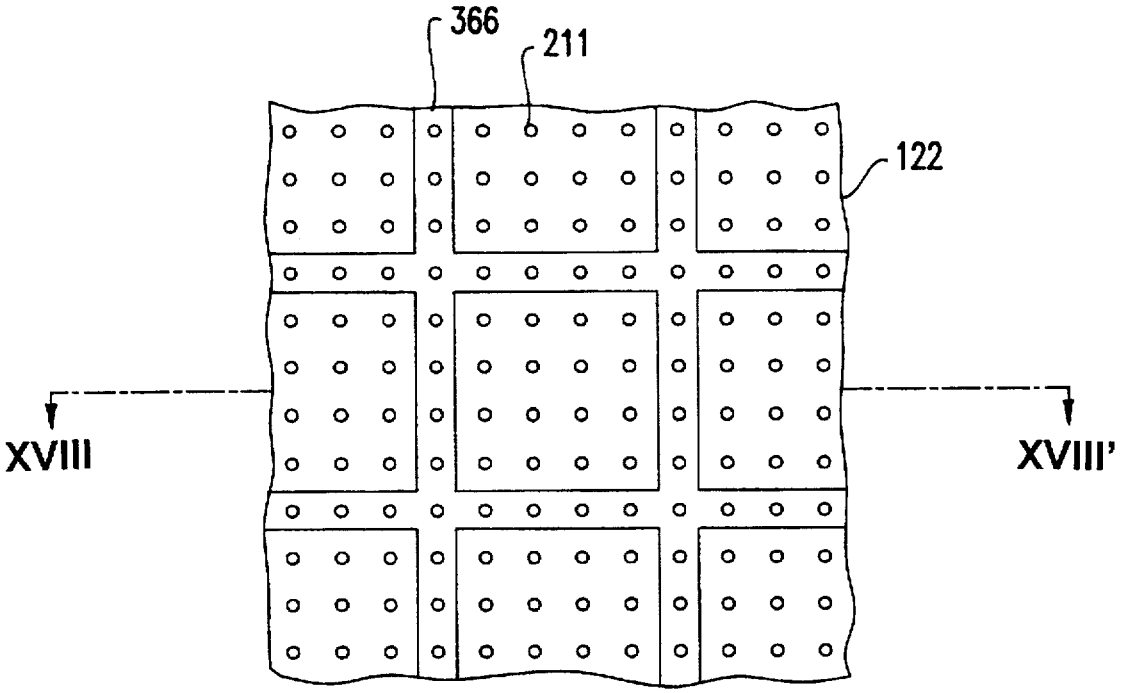
FIG. 17 is a plan view illustrating a sixth embodiment of the present invention.
Figure 18:
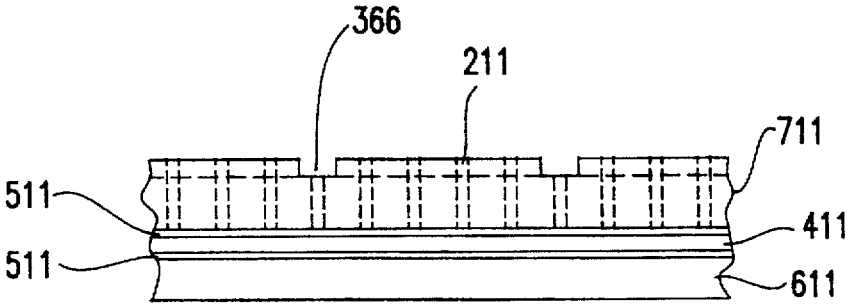
FIG. 18 is a cross sectional view taken along line A–A' in FIG. 17.

A polishing pad as the sixth embodiment is as shown in FIG. 17 and FIG. 18. The shape of the pad is the same as the pad of the first embodiment except for the width of tunnels. That is to say, the width of the tunnel 366 is wider than the width of the groove 311 of the first embodiment. Therefore the same figure caption as the first embodiment is used except for tunnels 366. The width of the tunnel 366 is wider than the diameter of the hole 211.

This embodiment has the same effects as the first embodiment.

Figure 19:
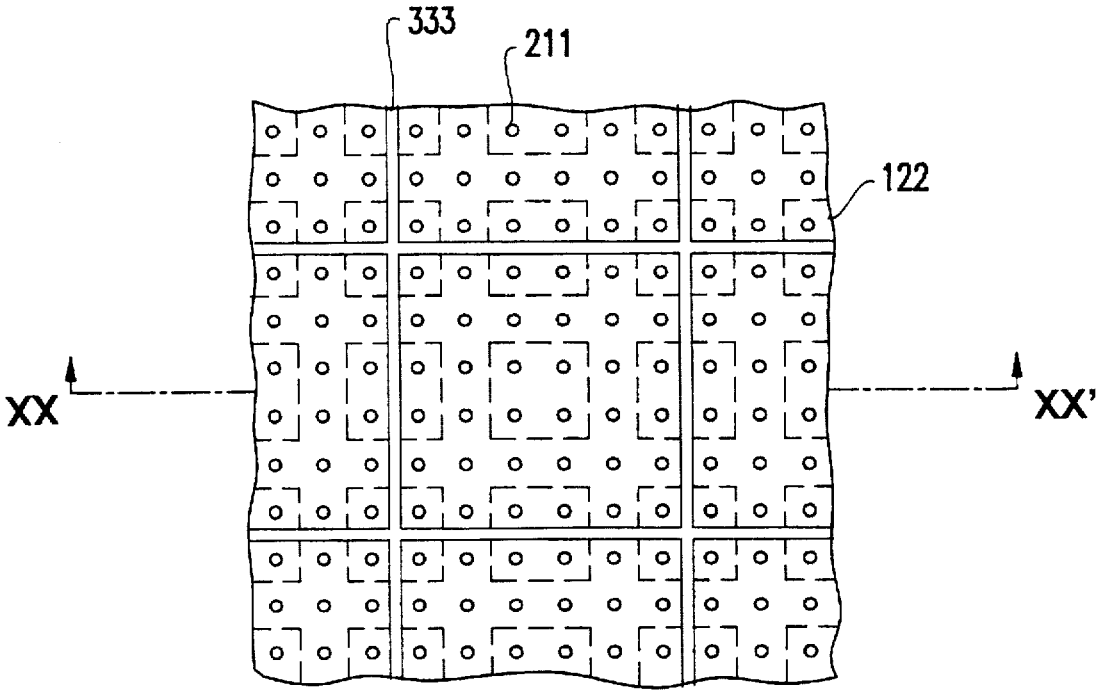
FIG. 19 is a plan view illustrating a seventh embodiment of the present invention.
Figure 20:
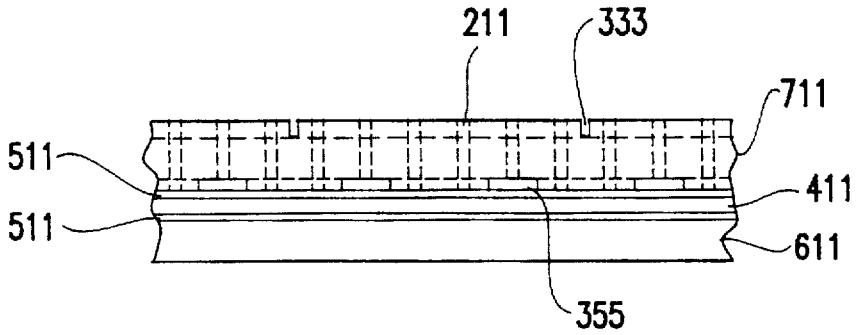
FIG. 20 is a cross sectional view taken along line A–A' in FIG. 19.

A polishing pad as the seventh embodiment is as shown in FIG. 19 and FIG. 20. This embodiment has the same characteristics as the third embodiment and the fifth embodiment. Therefore the same figure caption as the third and fifth embodiments is used.

This embodiment is preferable if it is needed to prevent the negative pressure effectively.

In the second, fourth, and fifth embodiments, the shape of the tunnels 322, 344, and 355 are a rectangle or a circle. But it is not limited to these shapes. If the shape is a circle, the diameter is from 0.2 mm to 0.5 mm. However it is about 0.3 mm preferably. It also is permissive to make the tunnels in the middle part of the hard layer 711 instead of the surface of the hard layer 711.

Although the invention has been described in detail above in connection with various preferred embodiments thereof, it will be appreciated by those skilled in the art that these embodiments have been provided solely for purposes of illustration, and are in no way to be considered as limiting the invention. Instead, various modifications and substitutions of equivalent techniques will be readily apparent to those skilled in the art upon substitutions are to be considered as falling within the true scope and spirit of the following claims.

What is claimed is:

1. A polishing pad, comprising:

a surface having a plurality of holes and a plurality of grooves, wherein a distance from a first groove of said grooves to a second groove of said grooves proximate said first groove is larger than a distance from a first hole of said holes to a second hole of said holes proximate said first hole.

2. A polishing pad as claimed in claim 1, wherein depths of said grooves are from 0.2 mm to 0.5 mm.

3. A polishing pad as claimed in claim 2, wherein widths of said grooves are smaller than diameters of said holes.

4. A polishing pad as claimed in claim 3, wherein said distance from said first hole to said second hole is about 5.0 mm.

5. A polishing pad as claimed in claim 4, wherein said first groove is connected to a plurality of holes of said holes.

6. A polishing pad as claimed in claim 5, wherein depths of said grooves are about 0.3 mm.

7. A polishing pad as claimed in claim 6, wherein diameters of said holes are about 1.5 mm.

8. A polishing pad having a plurality of holes and a plurality of tunnels, wherein a distance from a first tunnel of said tunnels to a second tunnel of said tunnels proximate said first tunnel is larger than a distance from a first hole of said holes to a second hole of said holes proximate said first hole.

9. A polishing pad as claimed in claim 8, wherein diameters of said tunnels are from 0.2 mm to 0.5 mm.

10. A polishing pad as claimed in claim 9, wherein widths of said tunnels are smaller than diameters of said holes.

11. A polishing pad as claimed in claim 10, wherein said distance from said first hole to said second hole is about 5.0 mm.

12. A polishing pad as claimed in claim 11, wherein said first tunnel is connected to a plurality of holes of said holes.

13. A polishing pad as claimed in claim 12, wherein diameters of said tunnels are about 0.3 mm.

14. A polishing pad as claimed in claim 13, wherein diameters of said holes are about 5.0 mm.

15. A polishing device, comprising:

a turning table with a polishing pad having a surface having a plurality of holes and a plurality of grooves; and a turning carrier for holding a semiconductor wafer, wherein said turning carrier is pushed against said polishing pad to polish said semiconductor wafer during polishing, and wherein a distance from a first groove of said grooves to a second groove of said grooves proximate said first groove is larger than a distance from a first hole of said holes to a second hole of said holes proximate said first hole.

16. A polishing device, comprising:

a turning table with a polishing pad having a plurality of holes and a plurality of tunnels; and a turning carrier for holding a semiconductor wafer, wherein said turning carrier is pushed against said polishing pad to polish said semiconductor wafer during polishing, and wherein a distance from a first tunnel of said tunnels to a second tunnel of said tunnels proximate said first tunnel is larger than a distance from a first hole of said holes to a second hole of said holes proximate said first hole.

17. A polishing device as claimed in claim 16, wherein diameters of said tunnels are from 0.2 mm to 0.5 mm.

18. A polishing device as claimed in claim 17, wherein widths of said tunnels are smaller than diameters of said holes.

19. A polishing device as claimed in claim 18, wherein said distance from said first hole to said second hole is about 5.0 mm, and said first tunnel is connected to a plurality of holes of said holes.

20. A polishing device as claimed in claim 19, wherein diameters of said tunnels are about 0.3 mm, and diameters of said holes are about 5.0 mm.

* * * * *

UNITED STATES PATENT AND TRADEMARK OFFICE

CERTIFICATE OF CORRECTION

PATENT NO. : 5,725,420
DATED : March 10, 1998
INVENTOR(S) : Koji Torii

It is certified that error appears in the above-identified patent and that said Letters Patent is hereby corrected as shown below:

Please correct column 3, line 20 as follows:
delete " A-A′ " and insert -- II-II′ --;

Please correct column 3, line 37 as follows:
delete " A-A′ " and insert -- VIII-VIII′ --;

Please correct column 3, line 41 as follows:
delete " A-A′ " and insert -- X-X′ --;

Please correct column 3, line 46 as follows:
delete " A-A′ " and insert -- XII-XII′ --;

Please correct column 3, line 57 as follows:
delete " A-A′ " and insert -- XVI-XVI′ --;

Please correct column 3, line 61 as follows:
delete " A-A′ " and insert -- XVIII-XVIII′ --;

Please correct column 3, line 65 as follows:
delete " A-A′ " and insert -- XX-XX′ --;

UNITED STATES PATENT AND TRADEMARK OFFICE

CERTIFICATE OF CORRECTION

PATENT NO. : 5,725,420

DATED : March 10, 1998

INVENTOR(S) : Koji Torii

It is certified that error appears in the above-identified patent and that said Letters Patent is hereby corrected as shown below:

Please correct column 4, line 11 as follows:
delete " B-B′ " and insert -- XXV-XXV′ --;

Please correct column 4, line 16 as follows:
delete " B-B′ " and insert -- XXVII-XXVII′ --.

Signed and Sealed this

Ninth Day of June, 1998

*Attest:*

*Attesting Officer*

Bruce Lehman

BRUCE LEHMAN

*Commissioner of Patents and Trademarks*